US009124005B2

(12) United States Patent
Nguyen et al.

(10) Patent No.: US 9,124,005 B2
(45) Date of Patent: Sep. 1, 2015

(54) DEVICE AND METHOD FOR IMPROVING LEAKY WAVE ANTENNA RADIATION EFFICIENCY

(75) Inventors: Van-Hoang Nguyen, Montreal (CA); Armin Parsa, Westmount (CA); Christophe Caloz, Montreal (CA); Samer Abielmona, Ottawa (CA)

(73) Assignee: CORPORATION DE LE'ECOLE POLYTECHNIQUE DE MONTREAL, Montreal, Quebec (CA)

( * ) Notice: Subject to any disclaimer, the term of this patent is extended or adjusted under 35 U.S.C. 154(b) by 310 days.

(21) Appl. No.: 13/512,635

(22) PCT Filed: Dec. 7, 2010

(86) PCT No.: PCT/CA2010/001947

§ 371 (c)(1),
(2), (4) Date: Jun. 29, 2012

(87) PCT Pub. No.: WO2011/069253

PCT Pub. Date: Jun. 16, 2011

(65) Prior Publication Data

US 2012/0262356 A1 Oct. 18, 2012

Related U.S. Application Data

(60) Provisional application No. 61/267,180, filed on Dec. 7, 2009.

(51) Int. Cl.
*H01Q 13/20* (2006.01)

(52) U.S. Cl.
CPC ..... *H01Q 13/20* (2013.01)

(58) Field of Classification Search
CPC ..... H01Q 13/20; H01Q 13/203; H01Q 13/28
USPC ..... 333/237
See application file for complete search history.

(56) References Cited

U.S. PATENT DOCUMENTS

2004/0227664 A1 11/2004 Noujeim
2004/0227668 A1 11/2004 Sievenpiper
2007/0010279 A1* 1/2007 Matsushita ..... 455/523

FOREIGN PATENT DOCUMENTS

GB 2 170 051 A 7/1986

OTHER PUBLICATIONS

Nguyen H V et al: "Highly Efficient Leaky-Wave Antenna Array Using a Power-Recycling Series Feeding Network", IEEE Antennas and Wireless Propagation Letters, IEEE, Piscataway, NJ, US, vol. 8, Jan. 1, 2009, pp. 441-444.

Hi Rano T et al: "A Design of a Leaky Waveguide Crossed-Slot Linear Array With a Matching Element by the Method of Moments With Numberi Cal-Eigenmode Basis Functions", IEICE Transactions on Communications Soci Ety, Tokyo, JP, vol. E88-B, No. 3, Mar. 1, 2005, pp. 1219-1226.

(Continued)

*Primary Examiner* — Benny Lee

(57) ABSTRACT

The present device and method improve radiation efficiency of a leaky wave antenna. The device and method collect non-radiated power signal from the leaky wave antenna, perform a passive operation on the non-radiated power signal to obtain a modified power signal, and radiate the modified power signal.

4 Claims, 11 Drawing Sheets

(56) References Cited

OTHER PUBLICATIONS

Hirano T et al: "Waveguide matching crossed-slot", IEE Proceedings: Microwaves, Antennas and Propagation , IEE, Stevenage, Herts, GB , vol. 150, No. 3, Jun. 10, 2003, pp. 143-146.

Fu W et al: "A Ring-Laser Type Quasi-Optical Osci Llator Using Leaky-Wave Antenna", 27th European Microwave Conference Proceedings, Jerusalem, Sep. 8-12, 1997 ; Proceedings of the European Microwave Conference, Jerusalem : ORTRA Ltd, IL, Sep. 8, 1997, pp. 181-184.

* cited by examiner

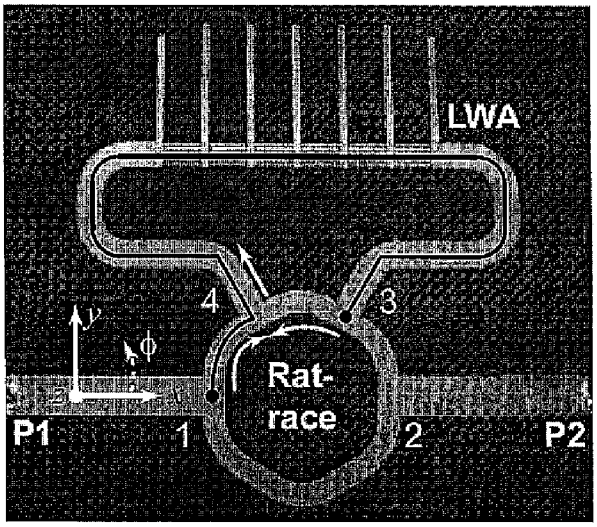
Figure 11
| | Open-loop LWA ($\eta = \eta_0$) | | Feedback LWA ($\eta = \eta_s$) | |
|---|---|---|---|---|
| | Full-wave | Measured | Full-wave | Measured |
| $G$ | 3.68 dB | 3.70 dB | 6.73 dB | 5.77 dB |
| $D$ | 7.84 dB | 7.88 dB | 7.85 dB | 7.42 dB |
| $\eta$ | 38.36% | 38.00% | 77.27% | 68.45% |
Figure 12
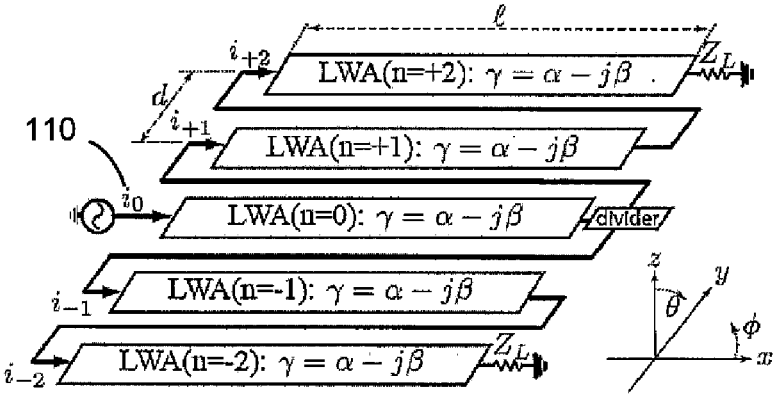
Figure 13

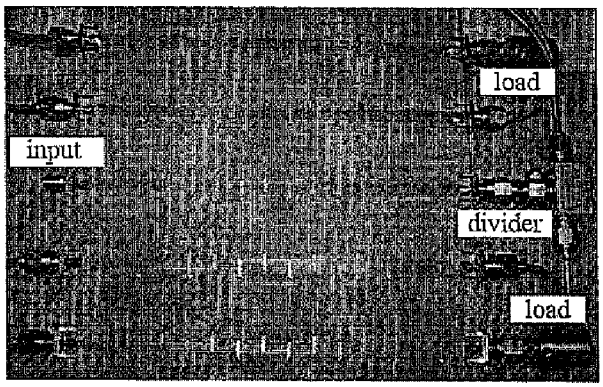
Figure 14
TABLE I
SIMULATED (ANSOFT DESIGNER) GAIN ($G$), DIRECTIVITY ($D$), HALF-POWER BEAM WIDTH (HPBW) AND EFFICIENCY ($\eta$) OF THE CRLH LWA ARRAY
| Number of array elements | $G$ | $D$ | HPBW | | $\eta$ |
|---|---|---|---|---|---|
| | | | $xz$-plane | $yz$-plane | |
| 1 | 6.84 dB | 11.15 dB | 30° | 96° | 37.60% |
| 3 | 10.72 dB | 12.53 dB | 31° | 62° | 65.89% |
| 5 | 12.45 dB | 13.51 dB | 31° | 45° | 78.29% |
Figure 15
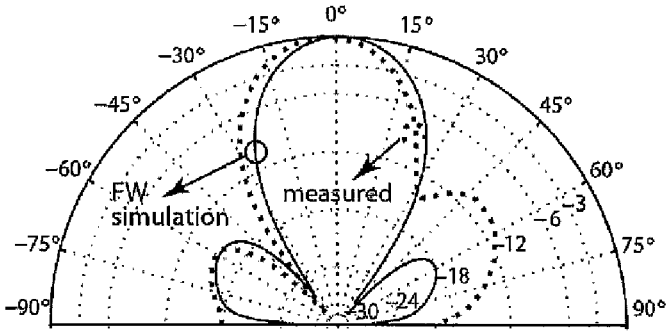
Figure 16

DEVICE AND METHOD FOR IMPROVING LEAKY WAVE ANTENNA RADIATION EFFICIENCY

The present relates to leaky wave antennas, and more particularly to a device and a method for improving leaky wave antenna radiation efficiency.

BACKGROUND

A Leaky Wave Antenna (LWA) is a wave-guiding structure that allows energy to leak out as it propagates along a direction of propagation. FIG. 1 depicts a conventional LWA circuit as known in the prior art. Conventional LWA circuits include an input (Vi) for generating an input power 110, a matching resistance (Ri), the LWA 100 of length l, and a termination load ZL. The input, such as for example a transmitter, provides the input power 110, of which a portion is leaked out during its propagation along the LWA 100. The leaked-out power is usually referred to as the radiated power. The remaining power 120, i.e. the difference between the input power 110 and the radiated power, is absorbed by the termination load, and is referred to as the non-radiated power. The LWA has a complex propagation constant $\gamma$ which follows the equation $$\gamma=\alpha+j*\beta$$

where $\alpha$ is an attenuation constant and $\alpha\neq0$;

j is the imaginary unit that satisfies the equation $j^2=-1$;

$\beta$ is a phase constant with a value $-k_0\leq\beta\leq k_0$; and $k_0$ is a free-space wave number.

The phase constant $\beta$ controls the direction of a main radiated beam $\theta$ (measured from an axis perpendicular to a plane of the LWA), which is given approximately as $\theta=\sin^{-1}(\beta/k_0)$. The attenuation constant $\alpha$ represents the leakage of radiated signals and therefore controls radiation efficiency $\eta_0$ of the LWA. The LWA's radiation efficiency is provided by the following equation:

$$\eta_0=\frac{P_{rad}}{P_i}=\frac{P_i-P_L-P_{loss}}{P_i}=1-e^{-2\alpha l},$$

where:

$P_{rad}$ is the radiated power;

$P_i$ is the input power;

$P_L$ is the non-radiated power lost in the termination load;

$P_{loss}$ is the power lost along the LWA; and l represents the length of the LWA.

Thus the radiation efficiency $\eta_0$ of the LWA directly depends on the attenuation constant and length of the LWA. To achieve better radiation efficiency, the physical length of the LWA must be sufficiently long to allow leaking out of sufficient transmitted power before reaching the termination load. For example, to achieve radiating 90% of the input power, the LWA may have to be longer than 10 wavelengths. Such a length is not practical at low frequencies, and for such reasons, most practical and finite size LWA suffer from low radiation efficiency.

BRIEF DESCRIPTION OF THE DRAWINGS

In the appended drawings, similar references denote like parts.

FIG. 11 illustrates a prototype of a feedback-based device comprising a rat-race coupler.

FIG. 12 represents simulated and measured performances of an open-loop LWA and a feedback-based device with a rat-race coupler.

FIG. 13 provides a perspective view of a power-recycling leaky wave antenna array using complementary series leaky wave antennas.

FIG. 14 represents a prototype of the power-recycling leaky wave antenna array of FIG. 13.

FIG. 15 represents simulated performances of the prototype of FIG. 14.

FIG. 16 depicts simulated and measured radiation patterns for the prototype of FIG. 14 in a longitudinal xz-plane cut at a broadside frequency.

DETAILED DESCRIPTION OF THE INVENTION

Figure 1:
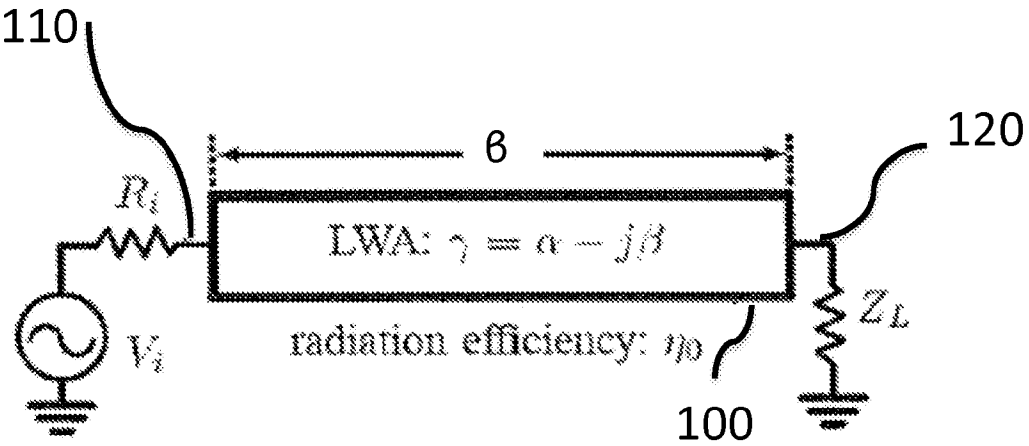
Figure 1 (prior art)
FIG. 1 is schematic representation of a prior art Leaky Wave Antenna.

The foregoing and other features of the present device and method will become more apparent upon reading of the following non-restrictive description of examples of implementation thereof, given by way of illustration only with reference to the accompanying drawings.

The present relates to a method and device for improving radiation efficiency of a leaky wave antenna. For doing so, the method collects non-radiated power signal by the leaky wave antenna, and performs a passive operation on the non-radiated power signal to generate a modified power signal. The method further radiates the modified power signal.

In another aspect of the method, the passive operation is one of the following: adding the non-radiated power signal to an input of the leaky wave antenna, or recycling the non-radiated power signal by dividing the non-radiated power signal in two concurrent non-radiated power signals and radiating the two concurrent non-radiated signals by complimentary leaky wave antennas.

In yet another aspect of the method, the passive operation comprises adding the non-radiated power signal to an input of the leaky wave antenna, the modified power signal is a sum of the non-radiated power and the input power of the leaky wave antenna, and radiating the modified power signal is performed by the leaky wave antenna.

In another aspect of the present method, the passive operation is recycling the non-radiated power signal into concurrent non-radiated power signals, the modified power signal is the concurrent non-radiated power signals, and radiating the modified power signal is performed by adjacent leaky wave antennas.

In a particular aspect of the present method, the sum is performed by a rat-race coupler.

In another aspect, there is provided a device for improving leaky wave antenna radiation efficiency. The device comprises an input for collecting non-radiated power signal, a passive component for performing an operation on the non-radiated power signal to generate a modified power signal, and an output for providing the modified power signal for radiation.

In another aspect of the present device, the passive component is one of the following: a power combining system or a divider with a series feeding network.

In another aspect of the present device, the modified power signal is one of the following: the non-radiated power signal with an input signal of the leaky wave antenna or a recycled non-radiated power signal.

In yet another aspect of the present device, the passive operation is performed by means of a power combining system, the modified power signal is a combination of the non-radiated power signal with an input power signal of the leaky wave antenna, and radiating of the modified power signal is performed by the leaky wave antenna.

In yet another particular aspect of the present device the passive operation is a divider, the modified power signal is a pair of recycled non-radiated power signals, and radiating of the pair of recycled non-radiated power signals is performed by at least one pair of complementing leaky wave antennas.

In another particular aspect of the present device, the power combining system is a passive rat-race coupler.

General Method and Device

As a leaky wave antenna only leaks a portion of the radiated power signal, the present method and device collects the non-radiated power signal, and performs a passive operation to obtain a modified power signal, and radiates the modified power signal. By collecting the non-radiated power, performing the passive operation thereto and radiating the modified power signal, the present method and device improve radiation efficiency of the leaky wave antenna. Thus, the present method and device does not alter the leaky wave antenna, but rather complements the latter so as to improve the radiation efficiency. Examples of leaky wave antennas to which the present method and device can advantageously complement comprise microstrip antennas made of Composite Right/Left Handed metamaterial.

Figure 2:
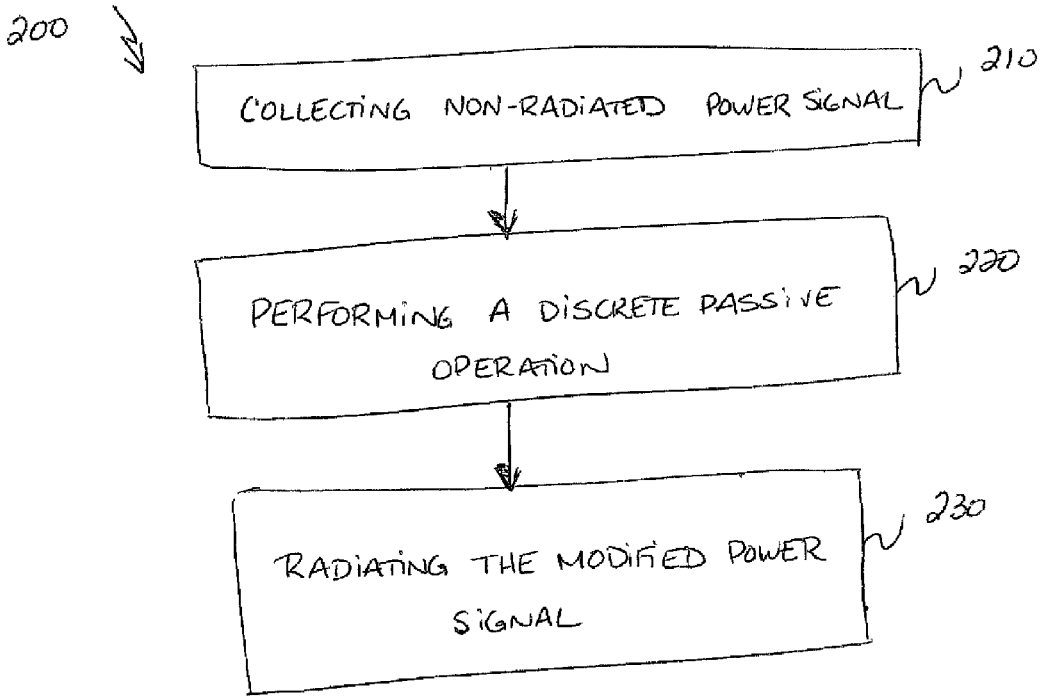
FIG. 2 is a flow diagram of a method for improving radiation efficiency of a leaky wave antenna in accordance with a general aspect.
Figure 4:
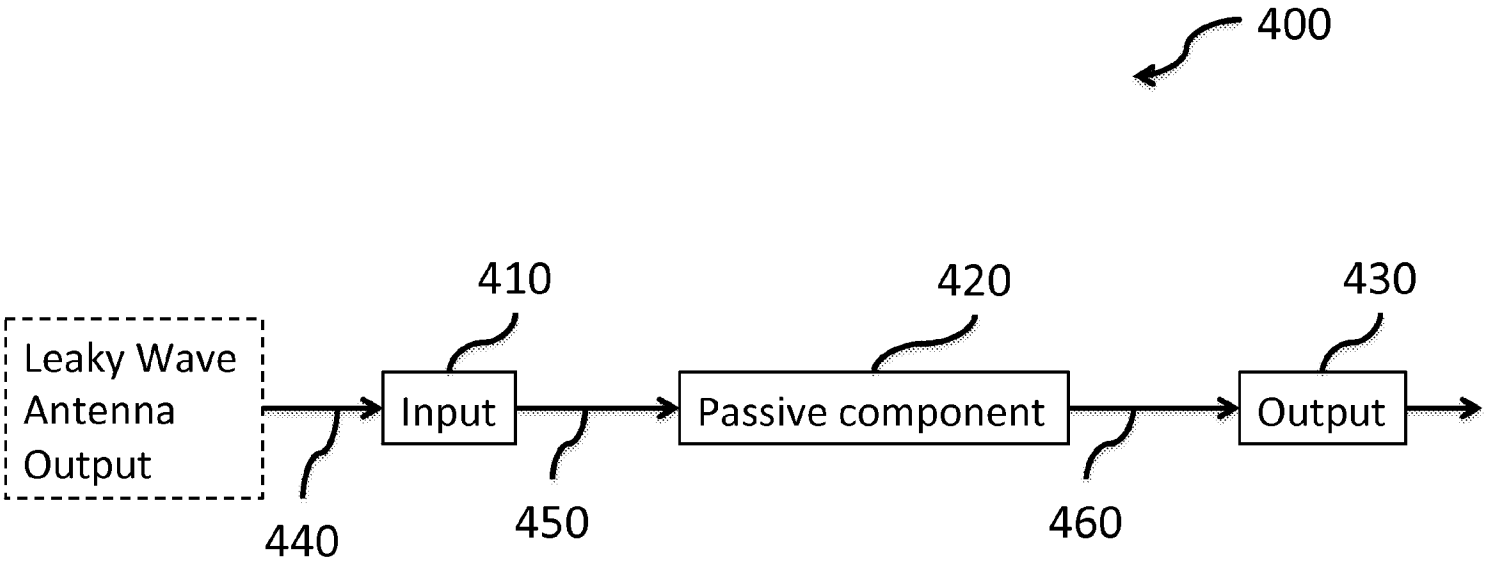
FIG. 4 is a schematic block diagram of a device for improving radiation efficiency of a leaky wave antenna.

Reference is now made concurrently to FIGS. 2 and 4, which respectively depict a flow diagram of a method and a device for improving radiation efficiency of a leaky wave antenna in accordance with a general aspect. More particularly, with reference to FIG. 2, the present method 200 collects non-radiated power 210 at an output of the leaky wave antenna. The method pursues by performing a passive operation 220 on the collected non-radiated power to generate a modified power signal. The method then radiates the modified power signal 230.

In another general aspect, with reference to FIG. 4, the present device 400 includes an input 410, a passive component 420 and an output 430. The input 410 is adapted for being connected to an output of the leaky wave antenna, such as in replacement to the traditional termination load. In operation, the input 410 collects non-radiated power signal 440 from the output of the leaky wave antenna. The input 410 may consist for example of one or several Sub-Miniaturized A (SMA) connectors.

The collected non-radiated power signal 440 is received by the passive component 420, which performs an operation on the non-radiated power signal 450 to generate a modified power signal 460. Examples of passive component may include a divider, a power combining system, or any other passive component which may perform an operation to the non-radiated power signal so as to generate a modified power signal to be radiated. Two examples of specific passive components will be subsequently discussed. The modified power signal 460 is then provided to the output 430 to be radiated.

The present method and device may advantageously improve radiation efficiency of leaky wave antennas for signals with lower frequencies, which are typically known for reduced radiation efficiency.

Feedback-Based Method and Device

In a particular aspect of the present method and device, the operation using passive component comprises adding the non-radiated power signal collected by the input 410 to an input power signal of the leaky wave antenna. This particular aspect is herein below called the feedback-based method and device. For doing so, the non-radiated power signal is collected at an output of the leaky wave antenna, before or in replacement of the termination load.

Figure 3:
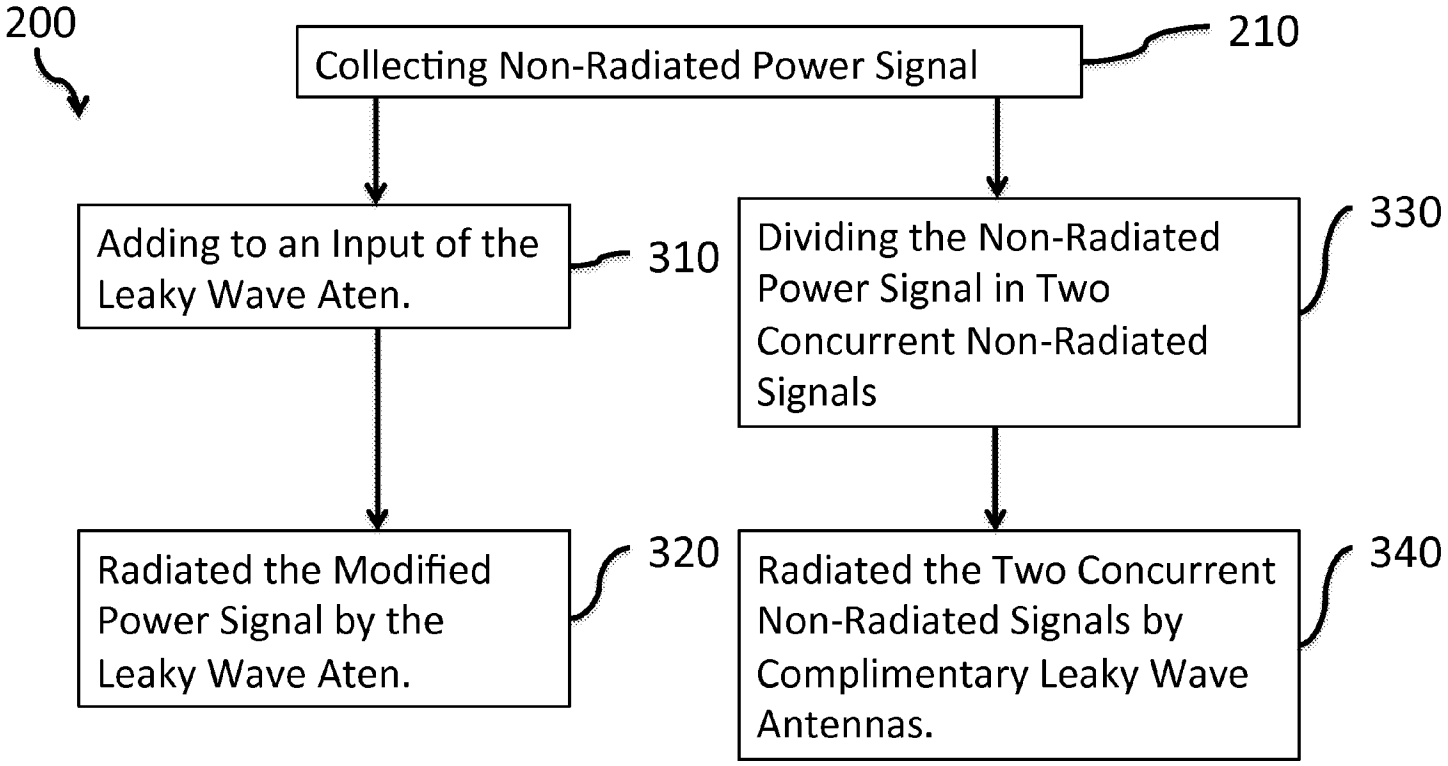
FIG. 3 is a flow diagram of other aspects of the present method.
Figure 5:
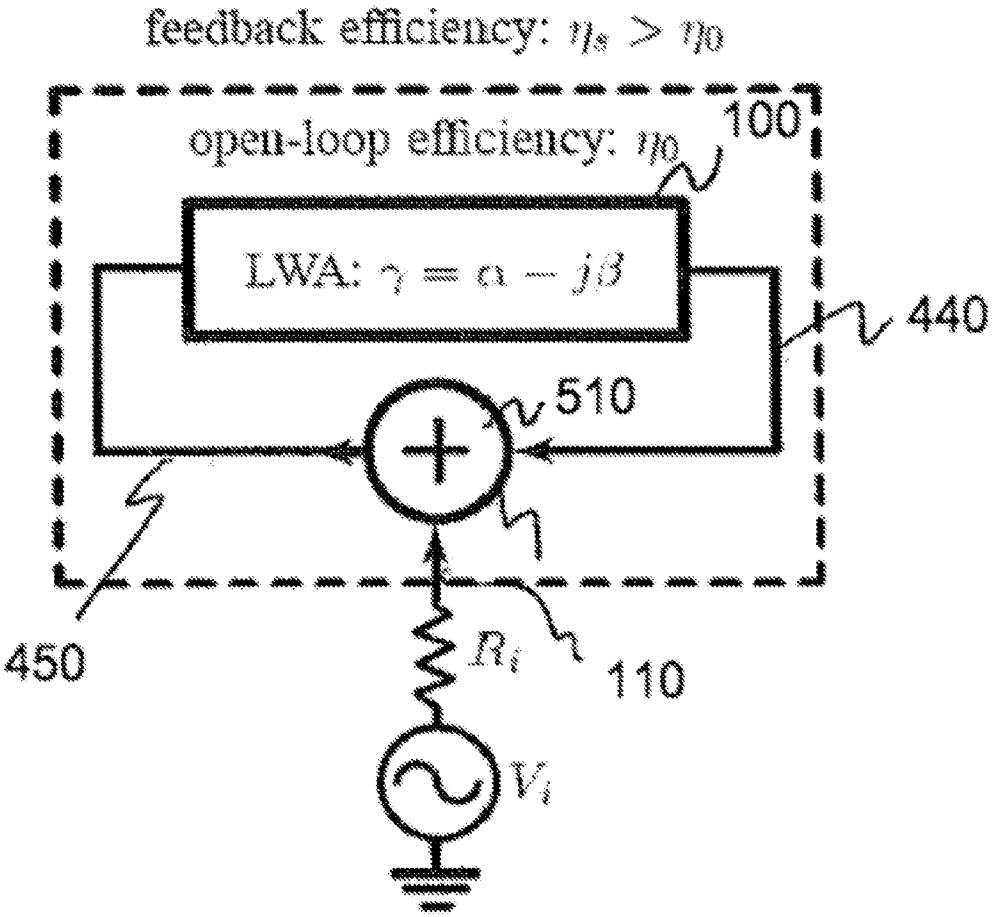
FIG. 5 is a schematic block diagram of an aspect of the device for improving radiation efficiency of a leaky wave antenna.

Reference is now concurrently made to FIGS. 3 and 5, which respectively depict a flow diagram and a schematic block diagram in which the passive operation and passive component are feedback related. In this particular aspect, with reference to FIG. 5, the non-radiated power signal 440 is collected and provided to a power combining system 510 to add the non-radiated power signal 440 to the input power signal 110. Thus, the modified power signal 450 is the combination or sum of the non-radiated power signal 440 to the input power signal 110. The modified power signal 450 is afterwards radiated by the leaky wave antenna 100.

Thus the method of this particular aspect, with reference to FIG. 3, collects the non-radiated power signal 210, adds the collected non-radiated power signal to an input of the leaky wave antenna 310 to obtain a modified power signal, and radiates the modified power signal by the leaky wave antenna 320.

In the present feedback-based method and device, the non-radiated power signal is recycled and fed back into the leaky wave antenna 100 (FIG. 5) so as to improve radiation efficiency.

Thus, with reference to FIG. 5, the non-radiated power signal 440 at the end of the leaky wave antenna 100, instead of being lost in the terminating load, is fed back to the input of the leaky wave antenna 100 through the power combining system 510, which constructively adds the input 110 and non-radiated power signal 440 while ensuring perfect matching and isolation of the two signals. As a result, the radiation efficiency of the isolated (or open-loop) leaky wave antenna, represented by $\eta_0$, is enhanced by the device's gain factor $G_s$ ($G_s>1$) to the overall radiation efficiency of $\eta_s=G_s\eta_0$, which may reach 100% for any value of $\eta_0$ in a lossless device. Thus, the present feedback-based device and method apply to all leaky wave antennas and solve their fundamental efficiency problem in practical applications involving a trade-off between relatively high directivity (higher than half-wavelength resonant antennas) and small size (smaller than open-loop leaky wave antennas or complex phased arrays).

The modified power signal 450 (FIG. 5) that appears at the input of the LWA 100 has larger amplitude than the applied input signal 110 for a non-zero recycled signal. As a result, the radiated power of the present device increases the radiation efficiency of the leaky wave antenna compared to the radiation efficiency of the leaky wave antenna without the present device.

Figure 6:
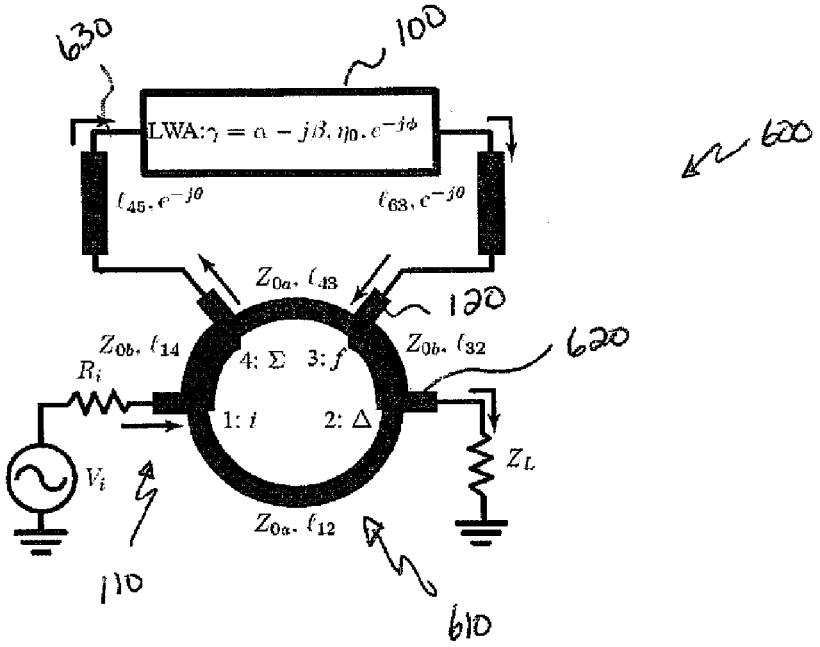
FIG. 6 is a schematic block diagram of another aspect of the present device for improving radiation efficiency of a leaky wave antenna.

The power combining system 510 may for example consist of an ideal adder as shown on FIG. 5, or a rat-race coupler as shown on FIG. 6. FIG. 6 depicts a schematic representation of a device 600 in accordance with the present feedback-based method, in which the power combining system 510 is a rat-race coupler 610. Two transmission lines, $l_{45}$ and $l_{63}$, have been added in the feedback loop to provide proper phase condition for maximal device efficiency, $\eta_s$. A difference port 620 is terminated by a matched load $Z_L$.

In this particular configuration of the feed-back based device, the rat-race coupler 610 constructively adds the input (i, port 1) and non-radiated power signal or feedback (f, port 3) signals at its sum port (Σ, port 4), toward the input of the leaky wave antenna 100, while using its difference port (Δ, port 2) for matching in a steady-state regime and for power regulation in a transient regime. In addition, the rat-race coupler 610 provides perfect isolation between the input 110 and feedback ports 120, which ensures complete decoupling between the corresponding signals. Via this positive (i.e. additive) mechanism, the power appearing at the input 630 of the leaky wave antenna 100 progressively increases during the transient regime until it reaches its steady-state level, leading to a radiation efficiency which could closely reach 100%.

As the leaky wave antenna 100 in open-loop configuration, i.e. without any feedback-based device as currently discussed, can be expressed as $\eta_s=G_s\eta_0$ where $\eta_0$ is the open-loop leaky wave antenna efficiency and $G_s$ is the present power-recycling gain defined as $G_s=P_4/P_1$. Therefore, for a 100% system radiation efficiency, the power-recycling gain is related to the open-loop leaky wave antenna efficiency as Gs (dB)=$1/\eta_0$, as shown in FIG. 7.

Figure 7:
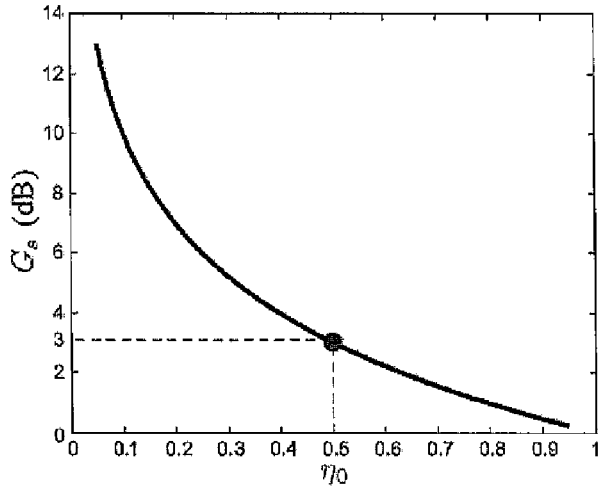
FIG. 7 is a chart depicting theoretical power-recycling gain versus radiation efficiency $\eta_0$ of an open-loop LWA for the present device and method.

The gain represented in FIG. 7 is not a gain in the sense of an active amplifier gain, where energy is added into the device by an external DC source, resulting in a device output power $P_{out}$ larger than the input power $P_{in}$, or $P_{out}=G\,P_{in}>P_{in}$. In the present aspect, the gain is provided by the feedback loop, which recycles the non-radiated power signal into the leaky wave antenna by means of the rat-race coupler 610. This leads to a larger power at the input 630 of the leaky wave antenna ($P_\Sigma$) compared to the power at the input 110 of the system 600 ($P_i$), $P_\Sigma=G_sP_i>P_i$, hence the analogy with an active system. However, no energy has been added to the overall system 600.

The power-recycling gain is achieved through a design of the rat-race coupler 610 that properly combines the input 110 and non-radiated power signal. In order to accommodate arbitrary power combining ratios and hence power-recycling gains, the rat-race coupler 610 includes two sets of transmission line sections (respectively $l_{43}$ and $l_{12}$, and $l_{14}$ and $l_{32}$), with respective impedances $Z_{0a}=Z_0/a$ and $Z_{0b}=Z_0/b$, as shown in FIG. 6, where a and b are positive real numbers satisfying the relation $a^2+b^2=1$. a and b are given as function of $\eta_0$ as follows: $a=\sqrt{1-n_0}$ and $b=\sqrt{\eta_0}$.

Figure 8:
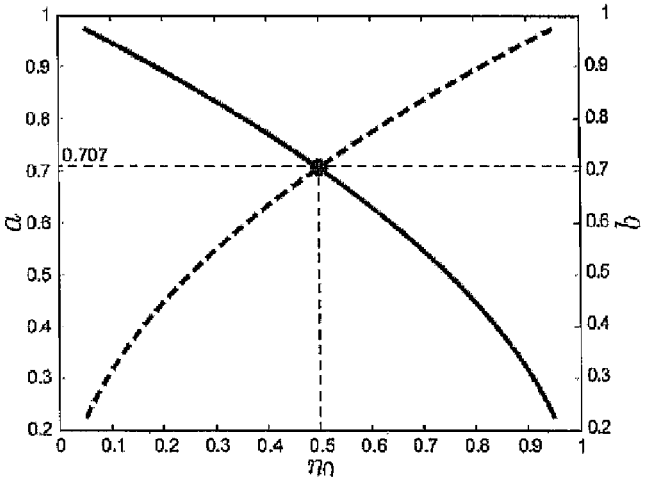
FIG. 8 represents normalized admittances a and b of a rat-race coupler.

FIG. 8 represents normalized admittances a and b of the rat-race coupler 610 as a function of the open-loop leaky wave antenna efficiency $\eta_0$. To ensure the input 110 and non-radiated power signals add constructively to yield a maximal efficiency, two transmission lines, $l_{45}$ and $l_{63}$ with a phase shift θ are added as shown in FIG. 6. This phase shift is given as $\theta=-\phi/2+3\pi/4+m\pi$ [1]. The intersection point of two curves corresponds to a=b=0.707 or a 3-dB rat-race coupler.

Experimental Results with a Rat-Race Coupler

Figure 9:
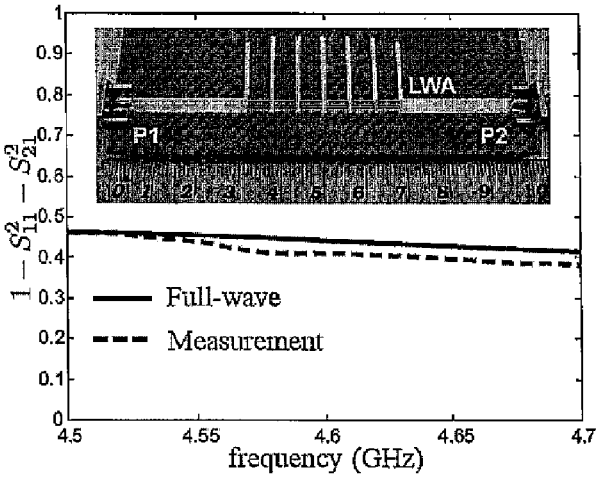
FIG. 9 shows simulated and measured dissipated power ratio of an open-loop LWA.
Figure 10:
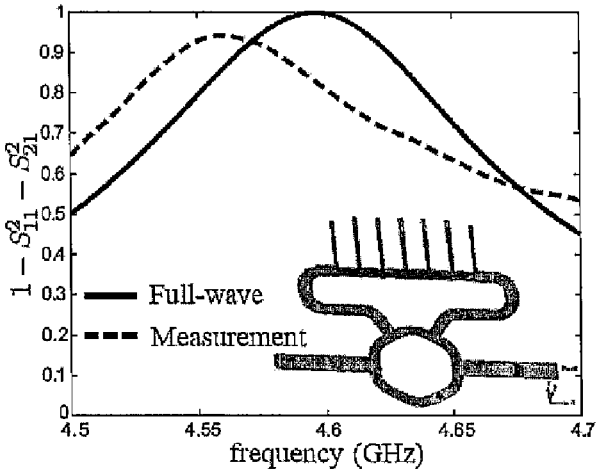
FIG. 10 shows simulated and measured dissipated power ratio of a feedback-based device with a rat-race coupler.

A 3-dB open-loop leaky wave antenna and a feedback-based device using a 3-dB leaky wave antenna and a rat-race coupler as a power combining system have been built and tested. FIGS. 9 and 10 respectively show simulated (Full-wave) and measured dissipated power ratio (as a function of an operating frequency in GHz) for the open-loop LWA and the feedback-based 3-dB LWA devices with a rat-race coupler. The dissipated power ratio is $1-S_{11}^2-S_{21}^2$, where $S_{11}$ represents return losses and $S_{21}$ represents insertion losses of the device. It can be seen that the dissipated power ratio has dramatically increased for the case of the feedback-based device 3-dB LWA. FIG. 11 illustrates the fabricated prototype of the feedback-based device in which the power combining system is a rat-race coupler. FIG. 12 summarizes the simulated (Full-wave) and measured performances of the open-loop leaky wave antenna and the feedback-based devices with a rat-race coupler, in terms of gain (G), density (D) and radiation efficiency (η). The measured radiation efficiency (η) has increased from 38% for the open-loop LWA to 68% for the feedback-based device.

Thus the present feed-back device and method self-recycles the non-radiated power of a single leaky wave antenna. For doing so, in a particular aspect, a passive rat-race coupler is used as a power combining system as regulating element to coherently combine the input and non-radiated power signals while ensuring perfect matching and isolation of the two signals, thereby enhancing the leaky wave antenna radiation efficiency. As the feed-back device is circuit-based, it can be used with any 2-port leaky wave antenna.

Power-Recycling Method and Device

In another aspect of the present device and method, the passive operation performed on the non-radiated power signal is recycling it into concurrent non-radiated power signals. In this particular aspect, the modified power signal is thus the two concurrent non-radiated power signals. The two concurrent non-radiated power signals are then radiated by at least one adjacent pair of complementing leaky wave antennas.

Reference is made back to FIG. 3. In this particular aspect, the radiation efficiency of a leaky wave antenna is improved by collecting the non-radiated power signal, recycling it into by dividing the non-radiated power signal in two concurrent non-radiated power signals 330, and radiating these two concurrent non-radiated power signals by external adjacent leaky wave antennas 340 also known as external antenna array. The antenna array radiates the non-radiated power signals in a coherent manner until the non-radiated power signals have completely leaked out. Consequently, there is more radiated power and therefore the array achieves high radiation efficiency and gain while maintaining a practical length in the direction of signal propagation.

In this particular power-recycling method and device, an external, passive series of adjacent leaky wave antennas and a power divider are used to guide the non-radiated power from the leaky wave antenna to one array element, and then to the next array element, etc. Because this method and device are external to the leaky wave antenna 100, it does not alter the complex propagation constant γ and therefore the direction of the main beam is unaffected. In addition, this method and device is universal and can be utilized to maximize the radiation efficiency of any 2-port leaky wave antenna.

Reference is now made to FIG. 13, which provides a perspective view of a power-recycling leaky wave antenna array using complementing series leaky wave antennas. FIG. 13, for illustration purposes, consists of five Composite Right/Left-Handed (CRLH) leaky wave elements, each having a length of l and spacing of d between adjacent elements. The input signal $i_0$ 110 is applied to the central element of the leaky wave antenna array at (x, y)=(0, 0) and progressively leaks out as it propagates along the CRLH LWA with a leakage factor $\alpha$. At the end of the central element (x, y)=(l, 0), the non-radiated power signal is equally divided into two concurrent non-radiated signals $i_{+1}$ and $i_{-1}$ which are fed into adjacent array elements at (x, y)=(0, d) and (x, y)=(0, −d), respectively. Similar to the input signal $i_0$, the two signals $i_{+1}$ and $i_{-1}$ propagate along the CRLH LWA and radiate with the same leakage factor rate of $\alpha$. Any non-radiated power from signals $i_{+1}$ and $i_{-1}$ at the end of the two array elements is directly recycled into signals $i_{+2}$ and $i_{-2}$ of the adjacent array elements at (x, y)=(0, 2d) and (x, y)=(0, −2d), respectively. The number of array elements N in the y-direction can be extended until all of the input signal power has leaked out before being terminated with matched termination loads. The leaky wave antenna array's radiation efficiency is given in the following equation.

$$\eta_{LWAarray} = \frac{P_{in} - P_{Load}}{P_{in}} = 1 - \frac{e^{-2(N+1)\alpha l}}{2}.$$

As can be seen from this equation, the radiation efficiency can be maximized by increasing the number of array elements N.

Thus the present power-recycling device and method use a passive series feeding network and a power divider to dramatically increase the total radiated power of a leaky wave antenna and therefore maximize radiation efficiency.

FIGS. 14 and 15 respectively represent a prototype of the power-recycling leaky wave antenna array of FIG. 13 and simulated performances of this prototype. The simulated performances include gain (G), density (D), Half-Power Beam Bandwidth (HPBW) in xz-plane yz-plane, and radiation efficiency ($\eta$), respectively for an array comprising 1, 3 and 5 leaky wave elements in series.

Figure 17:
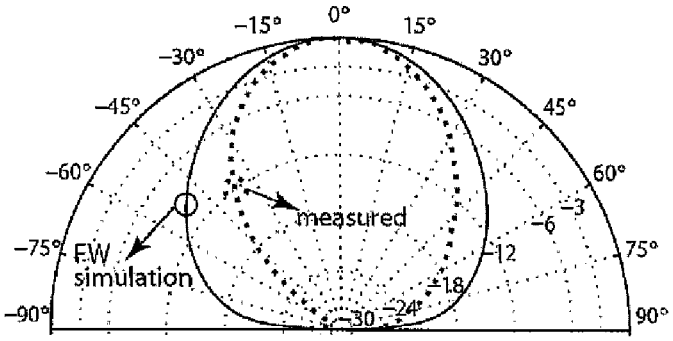
FIG. 17 depicts simulated and measured radiation patterns for the prototype of FIG. 14 in a transversal yz-plane cut at a broadside frequency.

FIGS. 16 and 17 respectively depict simulated and measured radiation patterns for the prototype of FIG. 14 in a longitudinal xz-plane cut at broadside frequency, and a transversal yz-plane cut at broadside frequency.

The experimental results obtained thus confirm that the present power-recycling device and method independently enhance the radiation efficiency by increasing the number of array elements N while keeping each element's length l constant. This is in contrast to conventional phased-array antennas where increasing the number of array elements does not enhance the radiation efficiency. Furthermore, as the non-radiated power is efficiently recycled within the array, a maximum level of radiated power is achieved for a given input power. Therefore, high gain is obtained along with high radiation efficiency.

FIGS. 16 and 17 further demonstrate that the half power beam width in both the longitudinal xz and transversal yz planes can be conveniently and independently controlled by adjusting the length l of each array element and the number N of array elements for a specific level of radiation efficiency. Finally, as the device and method are external to the leaky wave antenna and circuit-based, the present power-recycling device and method and be used with any 2-port leaky wave antenna.

Although the present method and device have been described in the foregoing description by way of illustrative embodiments thereof, these embodiments can be modified at will, within the scope of the appended claims without departing from the spirit and nature thereof.

What is claimed is:

1. A method for improving radiation efficiency of a leaky wave antenna, the method comprising:

collecting non-radiated power signal at an output of the leaky wave antenna;

performing a passive operation on the non-radiated power signal to generate a modified power signal; and radiating the modified power signal;

wherein:

performing the passive operation consists of adding the non-radiated power signal to an input of the leaky wave antenna;

the modified power signal is a sum of the non-radiated power and input power; and radiating the modified power signal is performed by the leaky wave antenna.

2. The method of claim 1, wherein the sum of the non-radiated power and input power is performed by a rat-race coupler.

3. A device for improving radiation efficiency of a leaky wave antenna, the device comprising:

an input for collecting a non-radiated power signal;

a passive component for performing an operation on the non-radiated power signal to generate a modified power signal; and an output for providing the modified power signal for radiation;

wherein:

the passive component is a power combining system;

the modified power signal is a combination of the non-radiated power signal with an input power signal of the leaky wave antenna; and radiating of the modified power signal is performed by the leaky wave antenna.

4. The device of claim 3, wherein the power combining system is a passive rat-race coupler.

* * * * *